United States Patent [19]

Peytavin

[11] 4,056,197

[45] Nov. 1, 1977

[54] TURNING MECHANISM FOR THE MOVEMENT OF LADLES IN STEEL MILLS

[75] Inventor: Pierre Peytavin, Neuilly-sur-Seine, France

[73] Assignee: Vallourec (Usines a Tubes de Lorraine-Escaut et Vallourec Reunies), Paris, France

[21] Appl. No.: 643,754

[22] Filed: Dec. 23, 1975

[30] Foreign Application Priority Data

June 26, 1973 France ..... 7323253
June 11, 1974 France ..... 7420103

Related U.S. Application Data

[62] Division of Ser. No. 482,638, June 24, 1974, Pat. No. 3,942,650.

[51] Int. Cl.[2] ..... B66C 1/44
[52] U.S. Cl. ..... 214/1 BC
[58] Field of Search ..... 214/1 B, 1 BD, 1 BC, 214/1 BH, 1 BV, DIG. 10, 130 R, 132, 151; 212/47, 75, 66, 68; 266/244–246

[56] References Cited

U.S. PATENT DOCUMENTS

| | | | |
|---|---|---|---|
| 1,629,184 | 5/1927 | Thomas | 214/132 X |
| 2,725,996 | 12/1955 | Britton | 212/66 X |
| 2,792,953 | 5/1957 | King | 214/146.5 |
| 3,098,395 | 7/1963 | Haganes | 212/66 X. |
| 3,391,810 | 7/1968 | LeTourneau | 212/47 X |
| 3,543,910 | 12/1970 | Devol | 214/1 BD |

FOREIGN PATENT DOCUMENTS

| | | | |
|---|---|---|---|
| 1,925,159 | 11/1970 | Germany | 214/1 BD |

*Primary Examiner*—Frank E. Werner
*Attorney, Agent, or Firm*—Brisebois & Kruger

[57] ABSTRACT

A turning mechanism for the movement of casting ladles in steel mills of the type wherein a member turning about a vertical shaft is provided with two diametrically opposite arms adapted to receive in each case a casting ladle. Each arm is fork-shaped and mounted to swing about a horizontal shaft fixed to the upper portion of the turning member. The two forked ends each receive a vertical support for the ladle pivotally mounted on a horizontal pivot received in the said forked end each support being pivotally connected at its upper end to one end of a rod whose other end is pivotally connected to the upper portion of the said turning member in such a way that the arm forms on each occasion with the corresponding rod a deformable parallelogram which constantly maintains the support in the vertical direction during the rotation of the arms.

5 Claims, 6 Drawing Figures

TURNING MECHANISM FOR THE MOVEMENT OF LADLES IN STEEL MILLS

This is a division, of application Ser. No. 482,638, filed June 24, 1974, now U.S. Pat. No. 3,942,650.

The present invention relates to a turning mechanism for the movement of ladles in steel mills.

In particular in connection with the continuous casting of steel it is often necessary to perform this continuous casting in a bay of the building which is not the same as that where the steel has been made and where the casting ladle is filled. This ladle can contain a large amount of molten steel, for example of the order of 50–150 metric tons. It is then necessary to construct a large travelling crane in the bay containing the continuous casting apparatus.

To eliminate this disadvantage it has already been proposed to construct transfer mechanisms pivoting about a vertical shaft and which are known as turning mechanisms.

These mechanisms are mounted on solid bases generally made from concrete supporting at a level corresponding to the continuous casting level a device comprising two horizontal arms adapted to receive a casting ladle at their ends, and said device can pivot about a vertical shaft. The pivoting device supporting the turning mechanism generally comprises a large diameter bearing such as those used in cranes. The rotation of the turning mechanism has the effect of bringing the ladle inside the bay where the continuous casting is performed whereby the said ladle can then be progressively emptied to perform the casting.

In certain continuous casting applications it is important to be able to modify the vertical position of the ladles on the turning mechanism so as to be able to easily control the supply of the receiving device for example a rotary continuous casting mould from the steel contained in the ladle by means of a tundish whereof the various flow rates into the ingot moulds are regulated by stoppers.

The stream leaving the ladle must be protected against oxidation by the air by means of a tube made from refractory material fixed underneath the ladle and dipping into the liquid bath of the tundish. However during casting it must be possible to unblock if necessary the gate with an oxygen jet and it is then necessary to raise the ladle and tube sufficiently high above the tundish to be able to perform this operation.

However the mechansims necessary for ensuring the mobility of the ladles of the turning mechanisms in the vertical direction further increase the already large size of the mould which takes up a large area adjacent to the continuous casting line. Moreover the weight of the turning mechanism is further increased which makes more costly and complicated the construction of the concrete block or the framework necessary for supporting the turning mechanism.

The invention proposes to supply a turning mechanism for the movement of casting ladles in steel mills which eliminates these disadvantages and permits the modification of the vertical position of the ladles whilst only having a reduced size, making it possible to reduce to a minimum the working platform used, for example a continuous casting platform. At the same time the weight to be supported as well as the cost price are reduced.

The invention also aims at improving the safety and protection of the sensitive members in the mechanism such as rotary bearings.

In continuous casting installations supplied with molten steel by ladles there is always a danger of an accidental leakage of steel outside the ladles so that it is necessary if such a leak takes place to turn the mechanism thereby moving the leaking ladle into a position above an emergency tank. For this operation to be successful it is necessary to ensure that the initial leak does not damage the bearings, driving devices and other important members comprising the turning mechanism. It is also necessary for the rotation to be performable in all circumstances even when the bearing or other members are damaged.

The present invention has for its object the new industrial product comprising a turning mechanism for the movement of casting ladles wherein a body which rotates about a vertical shaft is provided with two diametrically opposed arms which can each receive a casting ladle whereby the said turning mechanism has bearings protected by walls and means for raising and lowering the ladles of molten metal supported by the arms.

Preferably each arm is fork-shaped being articulated by its base about a horizontal shaft mounted in the upper portion of the turning mechanism whereby the two ends of the fork each receive a vertical support for the ladle articulated about a horizontal pivot received in the corresponding end whereby in addition each vertical support is articulated at the end of a rod whose other end is articulated to the upper portion of the mechanism in such a way that the rod forms with the corresponding branch of the fork of the arm a deformable articulated parallelogram which constantly maintains the support of the ladle in the vertical direction during the rotation of the arm.

In a preferred embodiment the rods are arranged above the arms and are articulated to the upper portion of the mechanism by an articulation shaft common to the rod assembly.

According to a particularly advantageous embodiment the mechanism supporting the articulations of the jacks substantially comprises a vertical rigid tubular member extending coaxially about a second inner tubular member resting by its base on the structure or framework of the installation and having in its upper portion a vertical pivot whereby the first rigid tubular member is pivotally mounted about the inner member by means of a first bearing arranged between the two rigid members substantially at the base thereof and an upper bearing arranged about the said vertical pivot whereby a vertical thrust bearing arranged level with the said pivot.

According to an advantageous embodiment the lifting jacks extend obliquely upwards and are articulated at their lower ends to the tubular member and at their upper ends to the corresponding end of the arm.

The lower articulations of the jacks are preferably at a distance above the casting floor which is greater than the height of a man.

In a particularly advantageous manner the casting floor supports a protective refractory cylindrical wall arranged around the turning mechanism which emerges from the casting floor and at a limited distance from the said turning mechanism.

In this way an additional protection of the turning mechanism is obtained relative to accidental leaks of the molten metal while increasing the space available in the immediate vicinity of the turning mechanism which considerably facilitates the manipulation of the members necessary for continuous casting purposes and notably the distribution tanks or tundishes which feed the casting mould or moulds.

According to a further improvement of the invention wherein the turning mechanism comprises the said rigid tubular member rotating about the second fixed coaxial tubular rigid member the driving means for rotating the turning mechanism which are conventially arranged at the base of the said mechanism below the casting floor are split into two by emergency means comprising a hydraulically or pneumatically operated member.

In this way it is ensured that a break-down or failure to operate of the conventional driving means which generally comprise an electric motor does not prevent the rotation of the turning mechanism more particularly when there is an incident such as a leak of moulten metal.

Advantageously the supplementary driving means can comprise peripheral teeth arranged around the turning mechanism and integral with the latter and co-operating with the end of the rod of a pneumatic or preferably hydraulic jack which for each stroke of the jack rotates the turning mechanism by one notch in the manner of a ratchet and pawl mechanism.

According to an improved embodiment of the invention for the supply of the said jack two pressure sources are provided whereby one is relatively small and permits a relatively rapid rotation of the turning mechanism and the other is much larger and only permits a slower rotation but with a force sufficient to ensure the rotation of the turning mechanism even in the case where the bearings arranged between the outer tubular portion of the mechanism and the fixed inner portions are damaged.

According to a special embodiment of the invention the ends of the fork form an arm which itself has a fork shape inside of which the vertical support of the ladle is articulated about a horizontal pivot supported by the two end fork members by means of a per se known weighing device.

Other and further objects of the present invention will be apparent from the following description and claims and are illustrated in the accompanying drawings which by way of illustration show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the scope of the appended claims.

Figure 1:
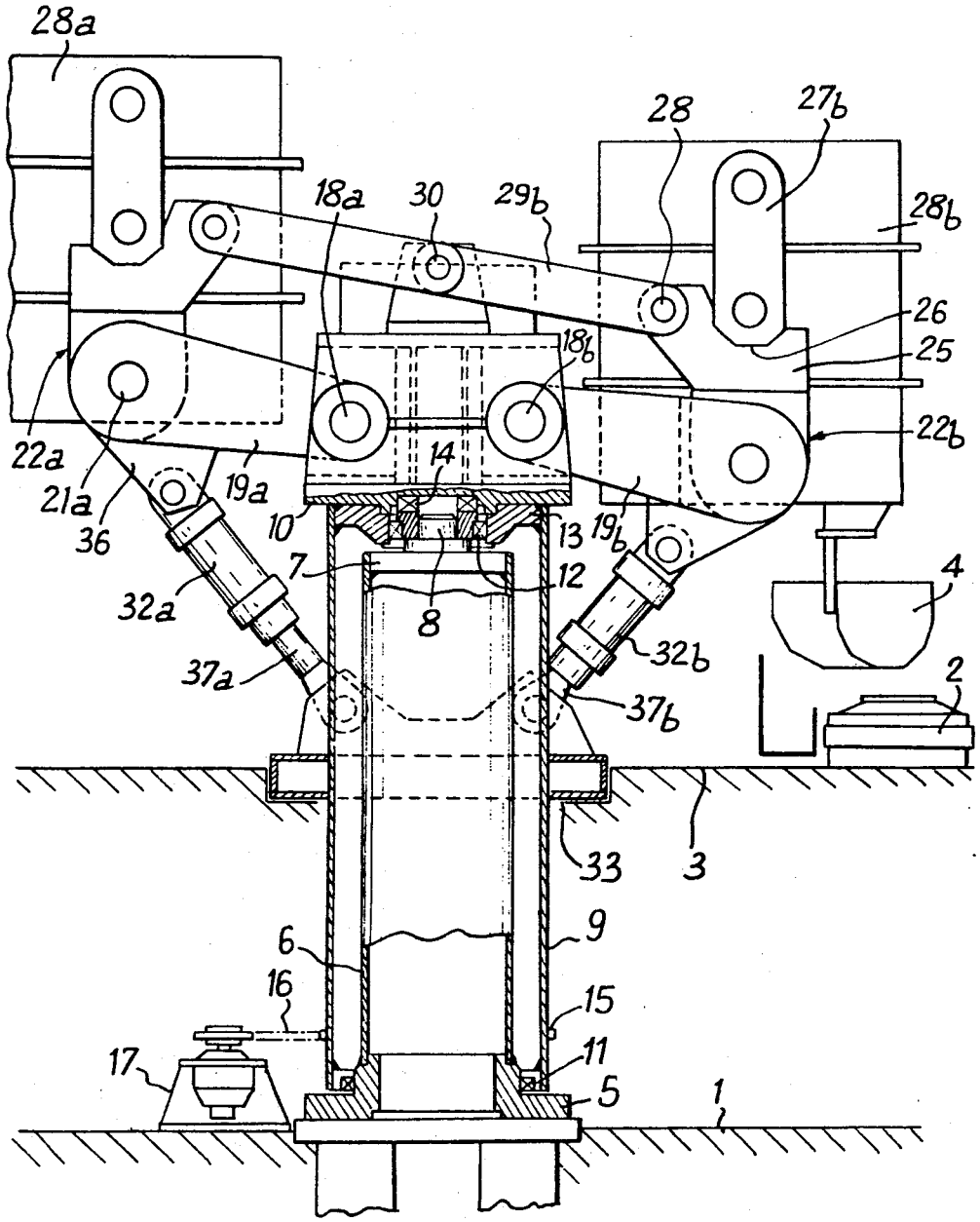
FIG. 1 is an elevational view partially in axial section, showing the turning mechanism according to the invention.

FIG. 1 shows the intermediate floor 1 of a rotary vertical continuous casting installation comprising in particular a mould 2 supported by an upper floor 3 whereby the said mould 2 is supplied under rigourously constant conditions by means of a tundish 4. The floor 1 supports a lower dome 5 having an L-shaped cross-section and whereof the end of the vertical portion supports a rigid steel tubular member 6 extending vertically upwards. In its upper portion the tubular member 6 has an end plate 7 which itself supports a short vertical pivot 8.

Around the inner tube 6 is arranged a second vertical rigid concentric tube 9 which terminates at its upper end in a head 10. The turning member 9 is able to rotate about the common vertical shaft by means of a first bearing 11 arranged between the vertical portion of dome 5 and the end of member 9 and the second bearing 12 arranged between pivot 8 and an inner ring 13 carried by the upper end of tube 9. A horizontal bearing 14 is arranged between pivot 8 and the lower central surface of head 10 in order to serve as a rotary vertical stop member.

Towards its lower end of the outer rigid member 9 has a toothed ring 15 which permits the vertical rotation of member 9 by means of a chain 16 driven by an appropriate motor 17.

Figure 2:
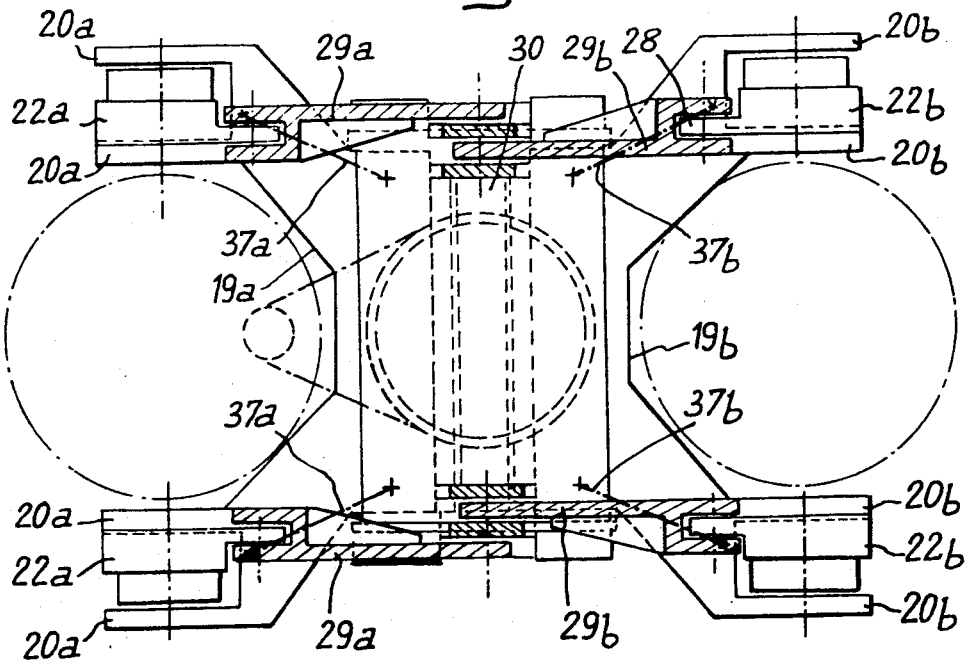
FIG. 2 shows a horizontal sectional view of the turning mechanism taken at the level of the rods.
Figure 3:
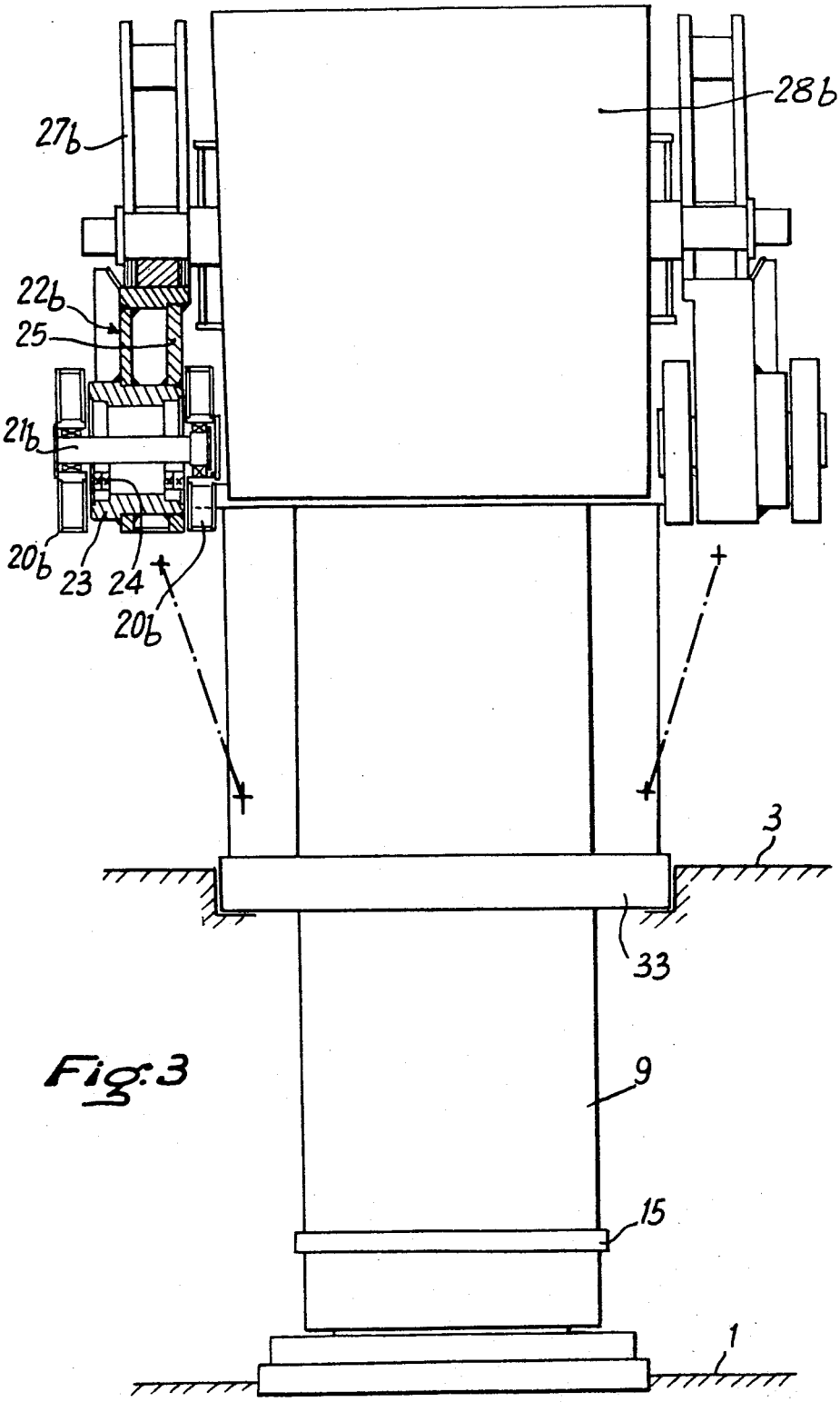
FIG. 3 is an end view with the end of one of the arms shown in section.

Head 10 on top of tubular member 9 carries symmetrically relative to the common vertical shaft two horizontal shafts **18*a* and 18*b* about which are articulated the two arms 19*a* and 19*b* which are fork-shaped and can be seen more particularly in FIG. 2. The base of each fork is articulated about the horizontal shaft 18*a* or 18*b* and the two ends of each fork are themselves divided in fork-like manner to form the parallel lugs 20*a* and 20*b*. Between the different lugs 20*a* or 20*b* are articulated about the pivots 21*a*, 21*b* carried by the respective lugs four vertical ladle supports 22*a* and 22*b*. As shown more particularly in FIG. 3, each has a cylindrical bush 23 which has between its inner surface and pivot 21*b* a weighing device 24 of a type known per se. The vertical support of ladle 22*b* also has a lug 25 integral with bush 23 whereby the upper portion of said lug 25 has an appropriate notch 26 which is adapted to receive the lower portion of one of the two attachment members 27*b* of the ladle 28*b*. Spaced from this notch 26 the lug 25 also has an articulation 28 permitting the articulation of the forked end of a rod 29*b* whose other end is articulated about a horizontal shaft 30 arranged centrally at the upper end of head 10. As can be seen more particularly in FIGS. 1 and 2 the shaft 30 is common to all the levers namely the two levers 29*b* co-operating with support 22*b* and the levers 29*a* co-operating with the support 22*a*. The distance between the articulation 28 and the articulation 30 is equal to the distance between the articulation 18*b* and the pivot 21*b* whereby the different geometrical axes of the different articulations are parallel in such a way that the arm 19*b* forms with the lever 29*b* the head 10 and the support 25 an articulated parallelogram which makes it possible to maintain constant the vertical direction of support 22*b* whatever the position of arm 19*b*** about its shaft.

Figure 4:
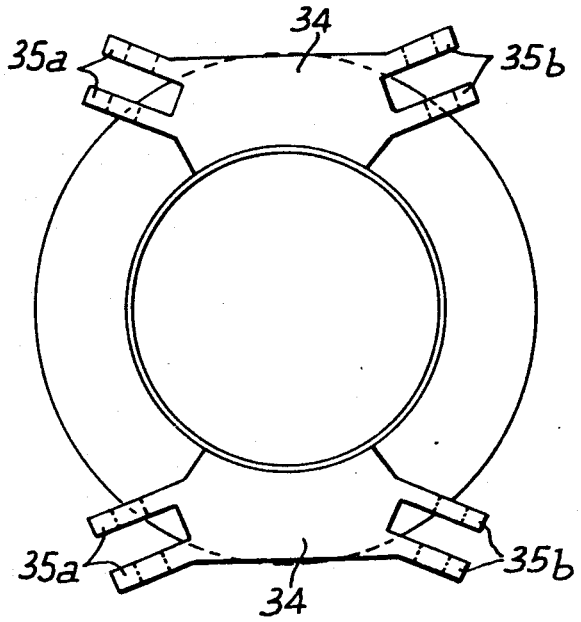
FIG. 4 shows a detail view of the turning mechanism.

In order to ensure the lifting of arms **19*a* and 19*b* about their respective shafts 18*a* and 18*b* the invention provides four jacks namely two jacks 31*a* for arm 19*a* and two jacks 32*b* for arm 19*b*. These jacks are articulated by their lower ends on the turning tubular member 9 substantially level with floor 3 by means of a ring 33 which supports on either side of member 9 two articulation members 35 each of which has two articulations forks 35*a*, 35*b* for receiving the ends of the different jack rods. The upper ends of the jacks are also articulated to the ends of the forks of the arms by means of articulation lugs 36 integral with the said forks in such a way that the direction of the jacks is oblique extending towards the outside from member 9 towards the end of arms 19***a* and 19*b* whereby the directions of the vertical planes containing the axes of jacks 37*a*, 37*b* are also inclined as can be seen in FIG. 4 in order to apply the jack pressures against the wall of tubular member 9.

It can be seen particularly in FIG. 1 that the turning mechanism according to the invention permits an important reduction in the overall dimensions taking account of the extremely high performances required of such turning mechanisms which must be able to support ladles of more than 100 metric tons. In particular it should be noted that by means of the invention it is possible to give the turning mechanism a maximum external diameter which does not exceed double the diameter of a ladle in such a way that the turning mechanism has when carrying ladles a diameter which is no greater than triple the diameter of the ladle.

Moreover, the diameter of the cylindrical member 9 can be relatively small, for example of the order of 2 meters, which makes it possible to disengage the mould and to arrange about the said mould various ancillary devices required for the continuous casting operation.

Figure 5:
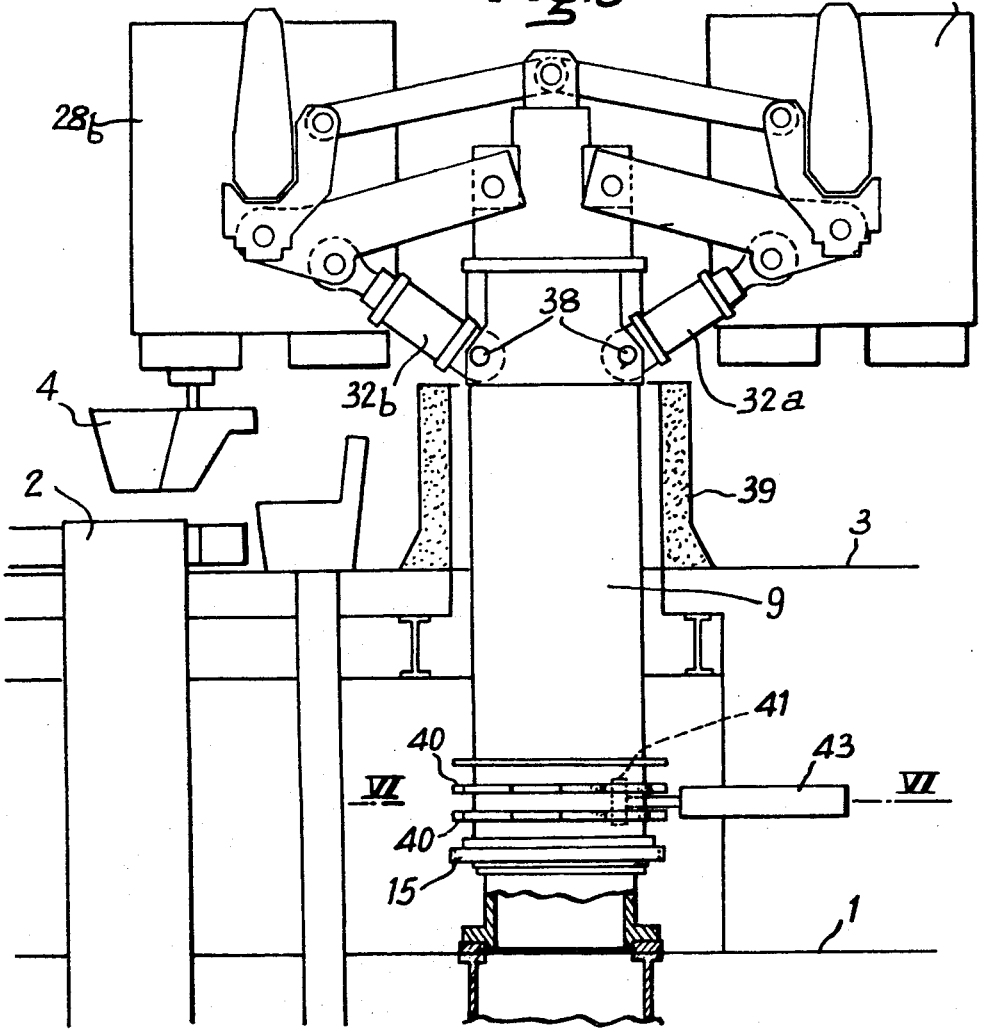
FIG. 5 is a schematic view showing in elevation the mechanism according to a variant of the invention.
Figure 6:
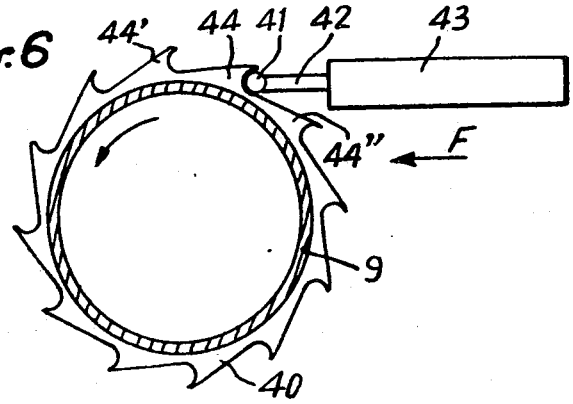
FIG. 6 is a schematic sectional view taken along the line VI—VI of FIG. 5.

Reference should now be made to FIGS. 5 and 6 which show a similar turning mechanism to that of FIG. 1.

It can be seen that a considerable portion of the tubular turning member 9 extends above the casting floor 3.

In accordance with the invention the pivoting of the arms and therefore of the ladles is effected with the aid of jacks 32*a*, 32*b* whose rods are articulated on these arms whilst the members are articulated on turning member 9 by means of articulation pivots 38. The vertical distance extending between the floor 3 and the articulations is greater than the height of a man whereby the jacks are arranged adjacent to the upper portion of turning member 9.

As can be seen in FIG. 5 a cylindrical wall made from a refractory material 39 is fixed to floor 3 and surrounds with a relatively small tolerance the emergent portion of member 9.

Obviously in this way if molten metal leaks from one of the ladles, member 9 as well as the radial space between the said member and the casting floor 3 are protected in such a way that the moulten metal will neither reach member 9 nor will it flow along the said member towards the elements arranged in the lower portion of the said member for bringing about its rotation. Moreover there is no danger that, as a result of damaging the member, the bearings arranged between the fixed tubular member 6 and the tubular member 9, i.e. bearings 11, 12, 14, will be damaged also.

Per se known and not shown driving means are arranged level with a lower floor 1 to co-operate with circular teeth 15 carried on the base of tubular member 9. The said driving means generally comprise an electric motor with a reduction gear whereby the driving pinion of the reduction gear can be spaced from the toothed ring 15 or brought into engagement with the said toothed ring to ensure the rotation of tubular member 9 and therefore the ladles.

In accordance with the invention the tubular member 9 has at a relatively small distance above ring 15 two toothed rings 14 spaced by a small distance from one another and having teeth whose shape is particularly clearly shown in FIG. 6. The said teeth are identical to those of a ratchet wheel and co-operate with a vertical finger 41 carried by the end of a rod 42 of a hydraulic jack 43. It can be seen that finger 41 comes into contact with the rear rounded portion of a tooth 44 of each of the superimposed rings and when the rod moves from its rear position shown in FIG. 6 towards its front position in the direction of the arrow F, the rod of the jack supported on the rear of the tooth 44 rotates the ring until tooth 44 has assumed the position of the previous tooth 44' shown in FIG. 6. At this moment the rearward return of the jack rod removes the finger from the teeth with which it was in contact to bring it into contact with the rear base of the following tooth 44''. Obviously the rod of the jack can optionally be articulated and have a certain clearance in order to be able to move out of the previous tooth and enter the following tooth.

Cylinder 43 is supplied with hydraulic liquid from a pressure source which can for example have a pump supplying a pressure tank and driven by an electric motor having an independent electrical supply which can continue to function even in the case of a current failure in the main motor (not shown) which normally permits the rotation of member 9 by means to teeth 15.

In a particularly advantageous variant a double supply to the jack 43 can be provided one from a pump-tank assembly supplying a pressure of the order of 30 Kg for a relatively rapid rotation but with a relatively small thrust and the other by means of a pump-tank system supplying a much higher pressure of the order of 250 Kg for a much slower but more powerful thrust of rod 42.

Thus, in the case of a break-down of the main motor, and more particularly in the case of an incident such as an accidental leakage of the molten metal, the operator can turn the turning member by means of the low pressure hydraulic source by acting on jack 43 in such a way as to bring the leaking ladle above the emergency tank (not shown). If the pressure in the jack 43 proves to be insufficient to turn the member 9, for example due to damage to the bearings as a result of the leak, the operator then uses the high pressure liquid source which then acts on the double set of teeth with a force which is sufficient to rotate the member even in the case of locking or damage to the bearings.

While the preferred embodiments of the invention have been described and illustrated it is to be understood that these are capable of variation and modification and it is not therefore desired to be limited to the precise details set forth but to include such modifications and alterations as lie within the scope of the appended claims.

What is claimed is:

1. A turning mechanism for the movement of heavy ladles in steel mills comprising a rigid vertical shaft fixed by its lower extremity on a structure and having an upper extremity, a turning assembly mounted for turning around the rigid vertical shaft, and comprising:

a tubular vertical element surrounding the rigid vertical shaft and mounted for turning around the shaft, a first bearing for supporting the turning assembly and disposed appreciably at the lower extremity of and positioned between the tubular vertical element and the rigid vertical shaft, a second bearing at the upper extremity of the rigid vertical shaft, and forming a support bearing supporting the weight of the turning member, a head on top of and connected to the tubular vertical element, the head supporting by pivots, two arms in the form of diametrically opposed forks mounted in a pivoting fashion for receiving a casting ladle, means for pivoting said arms and including jacks supported by the tubular vertical element and extending obliquely between the arms and the tubular vertical element, drive means for rotating the tubular vertical element and disposed near the lower extremity of the tubular vertical element.

2. A mechanism according to claim 1 in which the drive means comprises a toothed ring fixed to and encircling the tubular vertical element at a location under a casting floor and jack means for turning the ring to rotate the tubular vertical element.

3. A turning mechanism according to claim 2 in which the jack means comprises a hydraulic jack.

4. A mechanism according to claim 2 in which the toothed ring comprises two spaced apart ring portions arranged one above the other.

5. A mechanism according to claim 2 which further comprises two pressure sources for supplying the jack means, one being of relatively high volume and low pressure to provide a relatively rapid stroke, and the other being of relatively high pressure and low volume to provide a slow stroke and which is reliable to turn the tubular vertical element even in the case of damage to the bearings.

* * * * *